US012618263B1

(12) United States Patent
Hicks

(10) Patent No.: US 12,618,263 B1
(45) Date of Patent: May 5, 2026

(54) HIGH TENSILE FENCE BRACING SYSTEM AND ATTACHMENT BRACKET DEVICES

(71) Applicant: Justin D. Hicks, White Hall, MD (US)

(72) Inventor: Justin D. Hicks, White Hall, MD (US)

( * ) Notice: Subject to any disclaimer, the term of this patent is extended or adjusted under 35 U.S.C. 154(b) by 0 days.

(21) Appl. No.: 19/235,136

(22) Filed: Jun. 11, 2025

(51) Int. Cl.
*E04H 17/20* (2006.01)
*E04H 17/14* (2006.01)

(52) U.S. Cl.
CPC ..... *E04H 17/23* (2021.01); *E04H 17/1448* (2021.01); *E04H 17/1488* (2021.01)

(58) Field of Classification Search
CPC ..... E04H 17/1448; E04H 17/1452; E04H 17/1488
See application file for complete search history.

(56) References Cited

U.S. PATENT DOCUMENTS

| | | | | |
|---|---|---|---|---|
| 392,948 | A * | 11/1888 | Cleaveland | E04F 11/1834 256/65.02 |
| 1,772,159 | A | 8/1930 | Roth | |
| 3,833,201 | A * | 9/1974 | Dill | E04H 17/1413 248/300 |
| 4,060,222 | A * | 11/1977 | Pitkin | E04H 17/1413 403/4 |
| 4,150,907 | A | 4/1979 | Thurnauer | |
| 4,767,232 | A | 8/1988 | Francis | |
| 5,362,030 | A | 11/1994 | Iler, Jr. et al. | |
| 5,547,169 | A | 8/1996 | Russell | |
| 7,669,836 | B2 * | 3/2010 | Trigg | E04H 17/1417 248/300 |
| 7,748,686 | B1 | 7/2010 | Harder | |
| D622,585 | S | 8/2010 | Walker, Jr. | |
| 8,083,214 | B2 | 12/2011 | DeRogatis et al. | |
| 8,113,489 | B1 | 2/2012 | Harder | |
| 9,133,645 | B2 | 9/2015 | Toglia et al. | |
| 10,794,063 | B1 | 10/2020 | Martin | |
| 2010/0038613 | A1 * | 2/2010 | Scruggs | E04H 17/20 256/65.02 |
| 2015/0252570 | A1 | 9/2015 | Springborn | |

FOREIGN PATENT DOCUMENTS

| | | | |
|---|---|---|---|
| FR | 2952103 | A1 | 5/2011 |
| GB | 2373260 | A | 9/2002 |
| JP | 6031460 | U | 3/1985 |

(Continued)

OTHER PUBLICATIONS

"1" Sq. Adjustable Swivel Ball Rail Bracket for Aluminum Fence Posts (Black)," quickshipaluminumfence.com, https://quickshipaluminumfence.com/store/1-x-1-adjustable-swivel-ball-bracket-black.html?gad_source=1&gclid=Cj0KCQiA6Ou5BhCrARIsAPoTxrC6m7QzdaDPYDP0dCwIT_sYz821NJ1ekvqaaQNkmaxF55TMGibgeH8aAqDSEALw_wcB [Date accessed: Dec. 5, 2024].

*Primary Examiner* — Michael P Ferguson
(74) *Attorney, Agent, or Firm* — Bold IP, PLLC; Houda El-Jarrah

(57) ABSTRACT

A fence bracing system. The fence bracing system uses an attachment bracket. The attachment bracket includes a plate that has a middle section and a left side section and a right side section bent back at an angle. In the middle section, one or more spherical connectors are fixedly attached (e.g., welded) to the center of the middle section. The attachment bracket is fastened to a fence post at any height needed on the fence post. An open end of the pipe is insertable and fits over the spherical connector. The attachment bracket allows for a tight fit for pipes held in place between fence posts.

10 Claims, 12 Drawing Sheets

(56) References Cited

FOREIGN PATENT DOCUMENTS

| | | | | | |
|---|---|---|---|---|---|
| KR | 100993547 | B1 | * | 11/2010 | ..... E04H 17/20 |
| KR | 20120033608 | A | | 4/2012 | |
| KR | 101264079 | B1 | | 5/2013 | |
| KR | 101429116 | B1 | | 8/2014 | |
| KR | 101559516 | B1 | | 10/2015 | |
| KR | 102006117 | B1 | | 7/2019 | |
| KR | 102165225 | B1 | | 10/2020 | |
| KR | 102289165 | B1 | | 8/2021 | |

* cited by examiner

HIGH TENSILE FENCE BRACING SYSTEM AND ATTACHMENT BRACKET DEVICES

FIELD OF THE DISCLOSURE

The present invention relates to a fence bracing system using an attachment bracket device that assists in bracing fence posts without having to cut into or bore holes or mortise the wood or metal fence post or another type of material for the fence post.

BACKGROUND

Installing fences, in particular, high tensile fences, often require bracing to prevent wires from pulling the fence posts down over time. Current systems require cutting into posts and fitting metal rails that can brace the posts in place. The wooden posts over time may easily lose their tension and begin to fail, requiring regular maintenance and repair. This is often a time-consuming process.

Accordingly, there is a need for an improved method for installing high tensile fencing systems.

SUMMARY

The present description includes non-limiting embodiments for an apparatus comprising an attachment bracket. The attachment bracket may be used for high tensile fencing installation. The attachment bracket may comprise a plate body, wherein the plate body comprises a middle section formed with a left side section and a right side section, wherein the left side section is bent backwards at an angle behind the middle section, and the right side section is bent at an angle behind the middle section, and at least one spherical connector formed in a shape of a sphere, wherein the at least one spherical connector is fixedly attached to a center of the middle section. The apparatus may further comprise at least one spherical connector has a diameter ranging between 1 inches to 4 inches. In a non-limiting embodiment, the at least one spherical connector has a diameter of 2 inches. The attachment bracket comprises two spherical connectors, wherein a first spherical connector is fixedly attached to the left side section of the plate body and a second spherical connector wherein the second spherical connector is fixedly attached to the right side section of the plate body. The apparatus may further comprise that the left side section and the right side section are bent at an angle behind the middle section ranging between 28-40 degrees. The attachment bracket comprises at least one fastener hole configured for receiving a fastener.

Other aspects and advantages of the invention will be apparent from the following description and the appended claims.

BRIEF DESCRIPTION OF THE DRAWINGS

Embodiments of the present disclosure are described in detail below with reference to the following drawings. These and other features, aspects, and advantages of the present disclosure will become better understood with regard to the following description, appended claims, and accompanying drawings. The drawings described herein are for illustrative purposes only of selected embodiments and not all possible implementations and are not intended to limit the scope of the present disclosure.

DETAILED DESCRIPTION

The present description includes exemplary embodiments for an attachment bracket device that may be used for high tensile fencing installation in particular. Further details are provided in reference to the accompanying Figures.

Figure 1A:
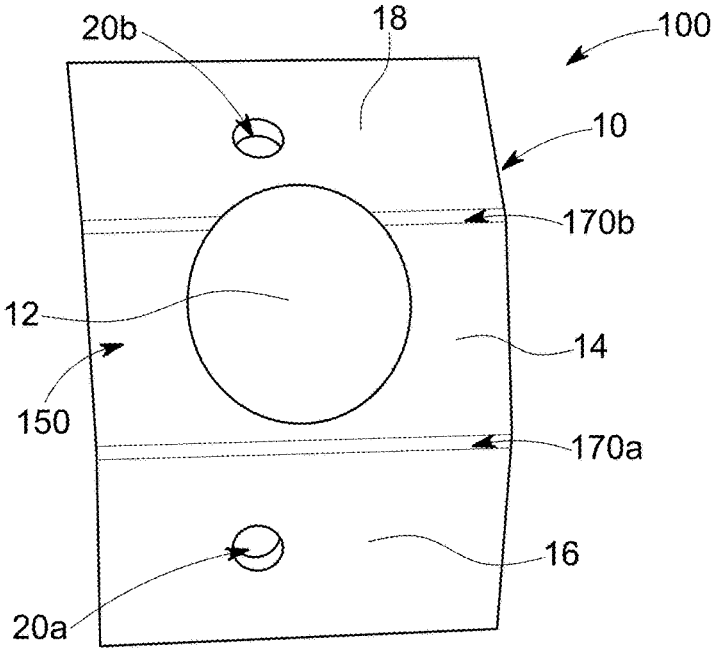
FIG. 1A is an exemplary embodiment of an attachment bracket device having one spherical connector.

FIG. 1A shows a front view of an exemplary attachment bracket device 100/200. It is noted that the term "attachment bracket device" is interchangeably used with the term "attachment bracket" herein.

Figure 2A:
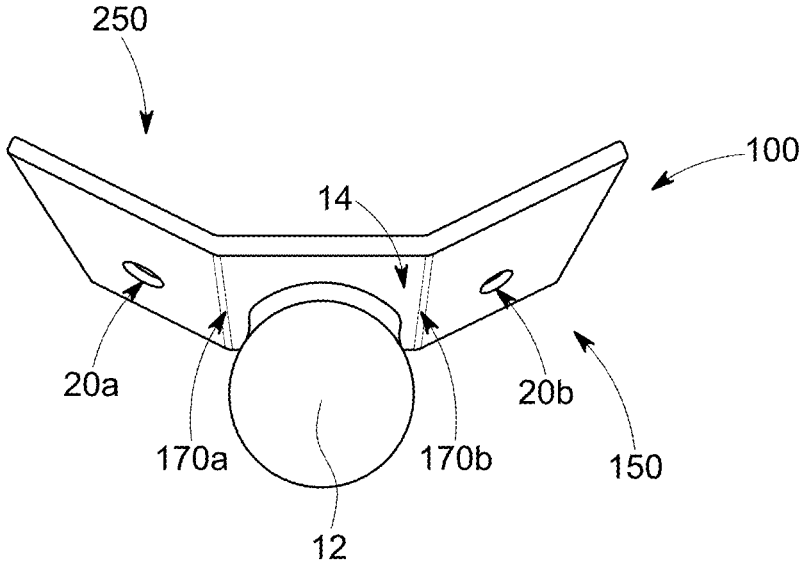
FIG. 2A is an exemplary perspective view of the attachment bracket device of FIG. 1A having one spherical connector.

In the attachment bracket device 100, as shown in FIG. 1A, there may be one or a single spherical connector piece or part 12, whereas in the embodiment shown in FIG. 2A of the attachment bracket device 200, there may be two spherical connector pieces 12*a*, 12*b*.

The attachment bracket device 100/200 may have an attachment plate 10 that is intended to be fastened (e.g. bolts/screws) to a fence post, such as fence post 402 shown in FIGS. 4-9. The attachment bracket device 100/200 may comprise a middle section 14 with a left side section 16 and a right side section 18 that are formed with/joined with the middle section 14 of the attachment bracket device 100/200. The attachment plate 10 may be made of one single plate as shown in FIGS. 1A-1B and FIGS. 2A-2B. Alternatively, the attachment plate 10 may be formed of two pieces 310, 312 such as shown in FIG. 3 in a non-limiting embodiment. The attachment plate 10 may include a frontal piece 310 joined with aback piece 312 as shown in FIG. 3.

Figure 1B:
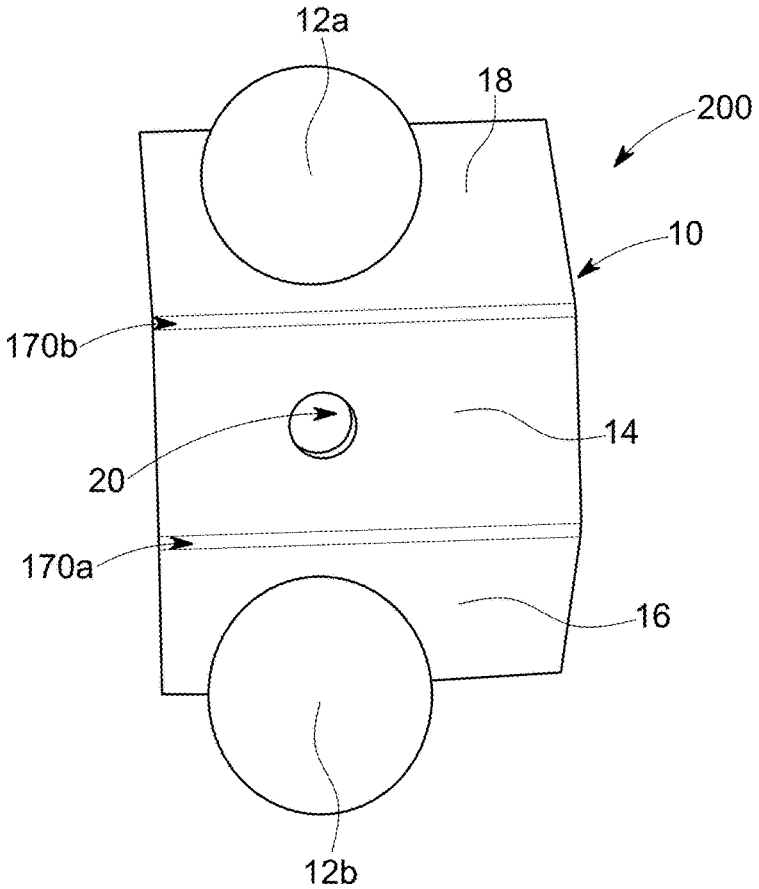
FIG. 1B is an exemplary embodiment of the attachment bracket device of FIG. 1A having two spherical connectors.
Figure 2B:
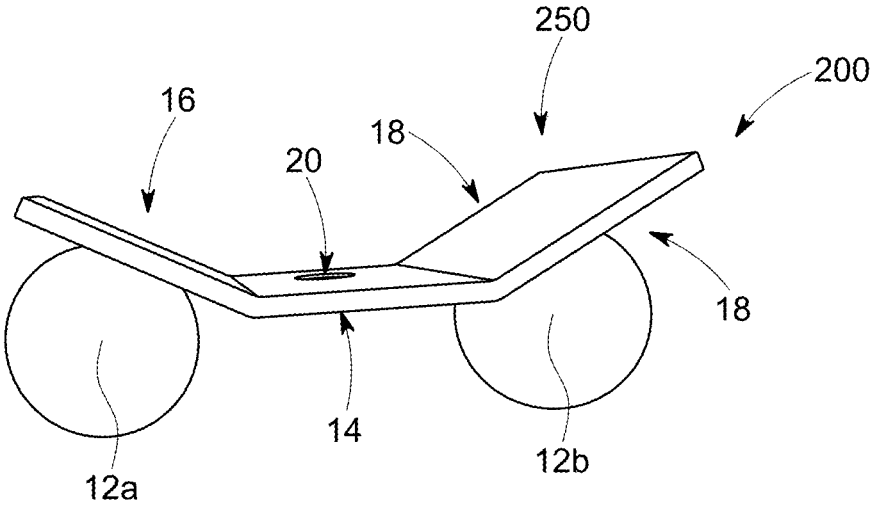
FIG. 2B is an exemplary rear perspective view of the attachment bracket device of FIG. 1B having two spherical connectors.
Figure 3:
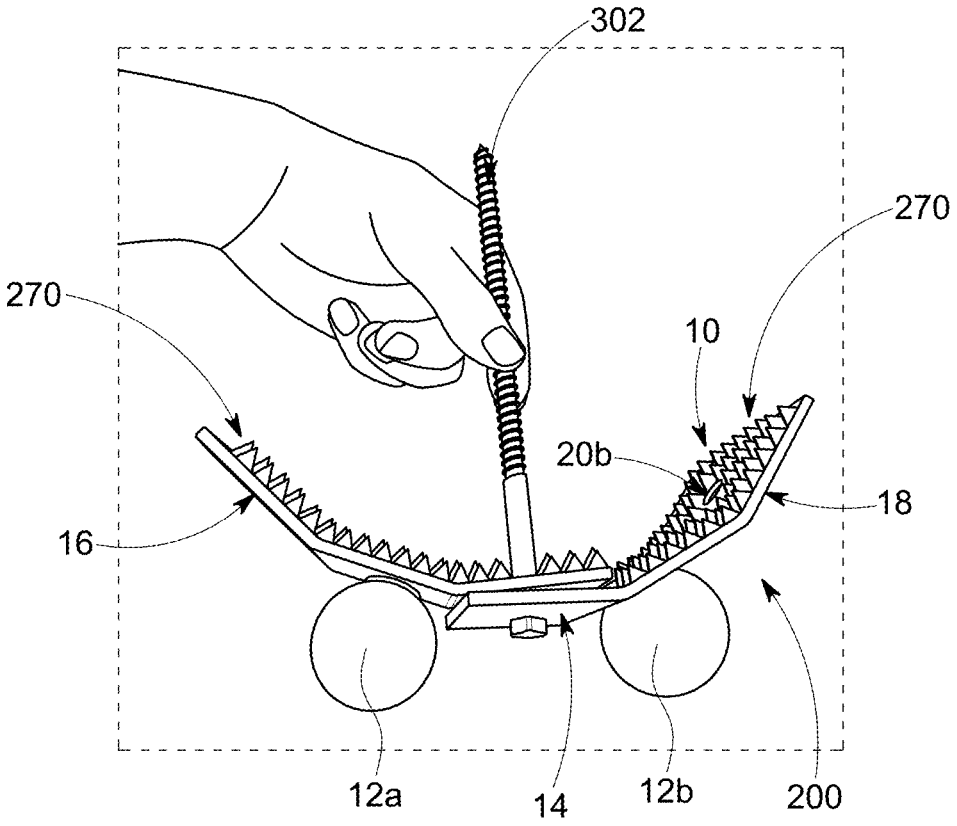
FIG. 3 is a pictorial illustration of the attachment bracket device having an exemplary fastener inserted through a hole of the attachment bracket device.

As shown in FIGS. 1A-2B, the left side section 16 and the right side section 18 are angled backwards from the middle section 14. The perspective view shown of the attachment bracket device 100/200 shown in FIGS. 2A-2B shows how the left side section 16 and the right side section 18 are recessed, angled behind at an angle from the straight middle section 14. As shown in FIG. 1A and in FIG. 1B, the left side section 16 is bent back and joins with the middle section 14 at joint 170*a*. The right side section 18 is bent back and joins with the middle section 14 at joint 170*b*. The left side section 16 and the right side section 18 are part of the plate body 10 as is the middle section 14 in one or more non-limiting embodiments. The left side section 16 and the right side section 18 may be bent slightly or partially to the back at an angle range of 20-40 degrees. The bending back of left side section 16 and the right side section 18 assists in having the left side section 16 and the right side section 18 conform better to the rounded, curved profile of a fence post, such as fence post 402 shown in FIG. 4.

The front side 150 of the attachment bracket device 100/200 shows that there may be one or more dedicated fastener through holes 20*a*, 20*b* that extend through the body of the attachment plate 10 from a front side 150 of the attachment bracket device 100/200 through to the back side 250 of the attachment bracket devices 100/200. The fasteners through holes 20*a*/20*b* are dedicated to receive a fastener, such as fastener 302 as shown in FIG. 3. The fastener 302 may be a longer screw/lag bolt that is intended to be used to fasten the attachment bracket device 100/200 and the whole attachment plate 10 to a fence post, such as fence post 402 shown in FIG. 4A and FIG. 4B. Notably, the attachment brackets 100/200 may each include a single fastener or more than one fastener, such as fastener 302 that may extend through dedicated fastener through holes to attach the attachment brackets 100/200 to the intended fence post 402.

FIG. 1B and FIG. 2B show that in the embodiment 200 that has two spherical connectors 12*a*, 12*b* there may be a singular fastener through hole 20 generally centrally located and extending through the middle section 14 of the attachment bracket device 200. In the embodiment of the attachment bracket device 100 having a singular connector 12, there may be two fastener holes 20*a*, 20*b* as shown in FIG. 1A and FIG. 2A. A first fastener hole 20*a* may be generally centrally located through the body of the left side section 16 while a second fastener hole 20*b* may be generally centrally located through the body of the right side section 18 of the attachment bracket device 100. The fastener holes 20, 20*a*, 20*b* may be punched or drilled through the plate body 10 in their respective locations.

The attachment bracket device 100/200 may be made of a single unit as shown in FIGS. 1A-2B. In a non-limiting embodiment, the left side section 16 may be integrally formed with the middle section 14 and the right side section 18. The plate body 10 may be a singular material unit and the left side section 16 and the right side section 18 may be bent backwards at an angle from the middle section 14 as shown in FIGS. 1A-2B. In a non-limiting embodiment, the spherical connector 12 may be a solid sphere. The plate body 10 may be initially a 4 to 5 inch flat bar or piece. The spherical connector 12 may be a fixed, non-moving single formed ball or sphere and it is a solid sphere in one or more non-limiting embodiments. As noted below, it may preferably be made of a durable metal and is fixedly and permanently welded or otherwise attached to the plate body 10 behind the spherical connector 12 or connectors 12 (e.g. attachment bracket 200).

Figure 4A:
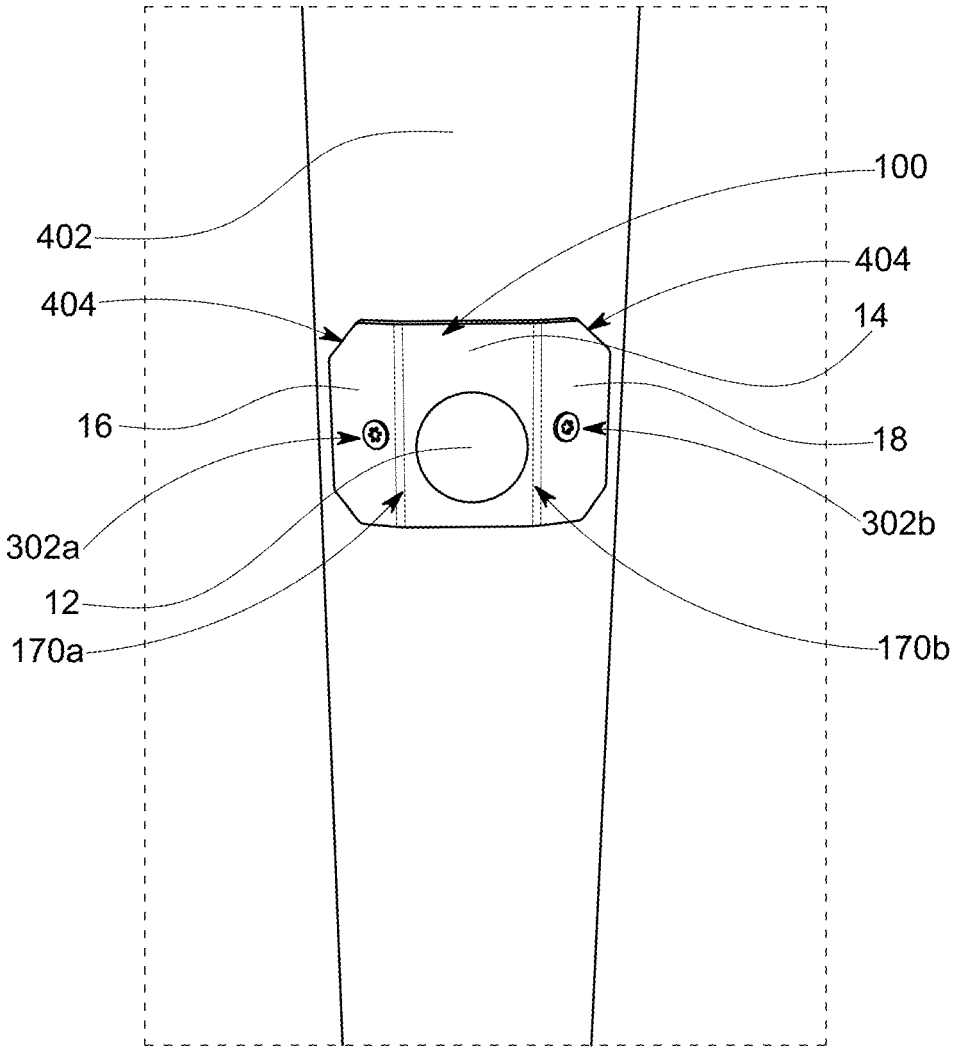
FIG. 4A is a pictorial illustration of the attachment bracket device of FIG. 1A having one spherical connector with the attachment bracket device installed on a fence post.
Figure 4B:
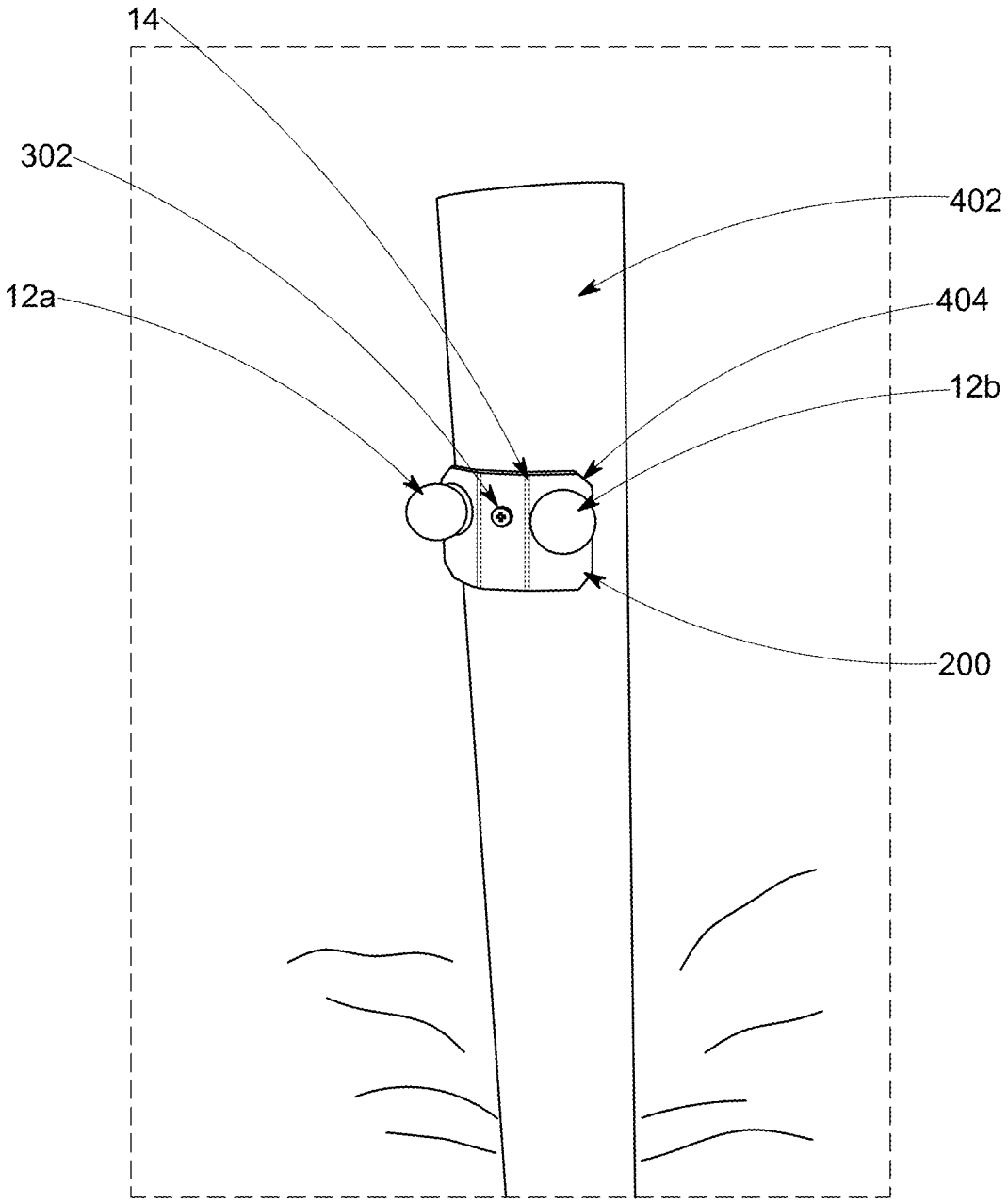
FIG. 4B is a pictorial illustration of the attachment bracket device of FIG. 1B having two spherical connectors with the attachment bracket device installed on a fence post.

FIG. 3 shows that there may be one or more spikes 270 attached to a rear side 250 of the plate body 10 of the attachment bracket device 100/200 which may be useful for providing more contact with the fence post 402 (e.g. as shown in FIGS. 4A-4B) that the attachment bracket devices 100/200 are attached to. The spikes 270 may be spread out across a rear surface 250 of the plate body 10 as shown in FIG. 3. Alternatively, there may be less spikes 270 relative to those shown in FIG. 3 that protrude from the rear surface 250 of the plate body 10 which may be used to further project into the surface of the fence post 402.

Additionally, as shown in FIG. 3, FIG. 3 shows that in another embodiment, for either attachment bracket device 100 or attachment bracket device 200, the plate body 10 may be made of two plates or two units, such as first plate 310 and second plate 312 as shown in FIG. 3.

Figure 5:
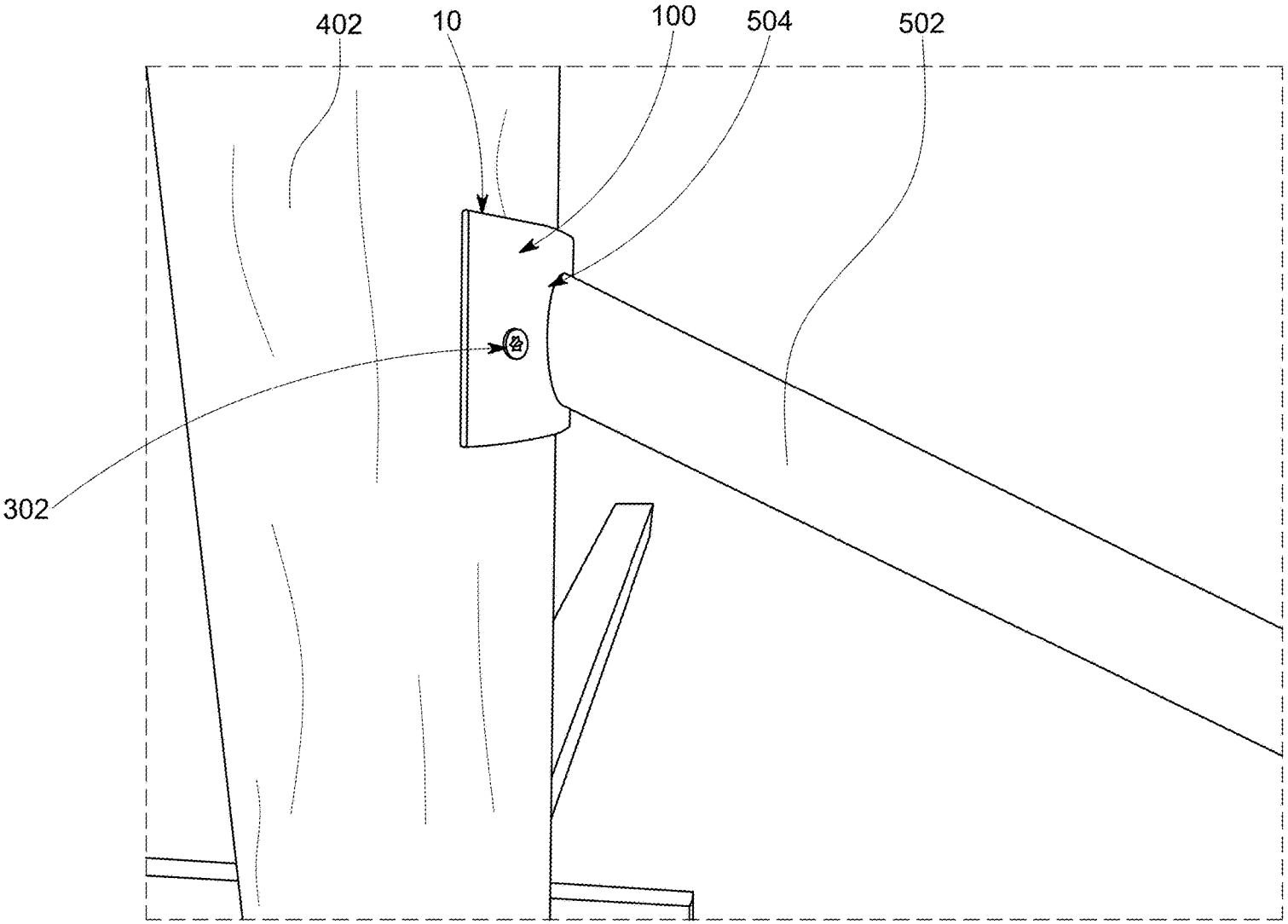
FIG. 5 is a pictorial illustration of the attachment bracket device of FIG. 1A attached to a fence post with a rail fitted over the spherical connector of the attachment bracket device.

In a non-limiting embodiment, the spherical connector 12 may have a diameter of approximately 2 inches to 2½ inches (2.0-2.5 inches) to accommodate most industry specified pipes (e.g., such as pipe 502 shown in FIG. 5). In some non-limiting embodiments, the spherical connector 12 may have a diameter ranging between 1 inch to 4 inches The spherical solid connector 12 or ball may be welded to or otherwise fixedly attached to the plate body 10 of the attachment bracket device 100/200. In a non-limiting embodiment, the spherical connector 12 is permanently affixed to the middle section 14 and is not removable. Additionally, the spherical connector(s) 12 do not rotate up or down or from side to side and are fixed in place and non-moving. In order to adjust an end of a pipe 502 to the spherical connector 12, the open end of the pipe (e.g. 502) is cut to onto the non-movable, stationary spherical connector 12. In a non-limiting embodiment, it may be preferable that the plate body 10 and the spherical connectors 12 be made of metal, such as, but not limited to steel. In a non-limiting embodiment, the thickness of the plate body 10 may be between ⅛ inches to ¼ inches (0.125 to 0.25 inches). In a non-limiting embodiment, the attachment bracket 100/200 may be approximately 2.5 inches to 4 inches tall or high.

FIG. 3 also shows the exemplary elongated fastener 302 that may be used to insert the fastener 302 through the dedicated fastener holes 20*a*, 20*b* and into a fence post, such as fence post 402 as shown in FIG. 4A.

As shown in FIG. 4A, the attachment bracket device can be attached with the fasteners 302*a*, 302*b* to the fence post 402 in a position on a front side or a back side of a fence post 402 as needed. In a non-limiting embodiment, the fence posts 402 may be made of wood.

As shown in FIG. 4A, the first fastener 302*a* is inserted through the fastener hole 20*a* in a left side section 16 of the plate body 10, while a second fastener 302*b* is inserted through the fastener hole 20*b* in a right side section 18 of the plate body 10. As shown in FIG. 4A, the left side section 16 is bent back and joins with the middle section 14 at joint 170*a*. The right side section 18 is bent back and joins with the middle section 14 at joint 170*b*. The left side section 16 and the right side section 18 are angled so as to conform onto the contacting surface of the fence post 402 rather than protruding from the side. As noted below, in a non-limiting embodiment, the joints 170*a*, 170*b* may be angled partially to the back behind the middle section 14 at a range anywhere between about 33 degrees or less (e.g. 0). The left side section 16 and the right side section 18 of the plate body are not positioned at 90 degrees or perpendicular to the middle section 14 in a preferred embodiment. Rather, the left side section 16 and the right side section 18 are intended to minimally angle back behind the middle section 14 at an angle such as approximately 33 degrees. It is noted that the range of angles that the left side section 16 and the right side section 18 may angle back away from the middle section 14 may be within 25-40 degrees or 30-40 degrees in one or more non-limiting embodiments.

The attachment bracket devices 100/200 are intended to be used so that another pipe can be slid over the spherical connectors 12 to connect one fence post 402 to another fence post 402.

FIG. 4B shows an example of the attachment bracket device 200 having two spherical connectors 12*a* and 12*b*. Advantageously, having two spherical connectors 12*a* and 12*b* allows for the angling of two separate pipes (e.g., pipes 502) that extend between fence posts 402 (e.g., as shown in FIGS. 5-9).

FIG. 4A and FIG. 4B also show that there may be alternative designs for the corners of the attachment bracket 100/200. As shown in FIG. 4A and FIG. 4B, the corners 404 of the attachment bracket 100/200 may be cut at an angle on each corner 404 so as to prevent the corners from piercing the skin of a human or an animal or causing other damage.

As shown in FIG. 5, a pipe, such as pipe 502, is inserted onto the spherical connector 12 of the attachment bracket device 100. The pipes 502 may be an industrial style pipe and may preferably be made of metal in one or more non-limiting embodiments. The pipe 502 may have an opening on each left end and the right end of the pipe 502. The pipe 502 may be cut if needed by the user at an angle 504, as shown in FIG. 5 so as to fit over the spherical connector 12. The spherical connector 12 fits by friction fit and contacts the inner surfaces of the pipe 502. A friction fit, also known as a press fit or interference fit, is a type of assembly where two components (e.g., the spherical connector 12 and the end opening of the pipes 502) are joined by a forced fit. In this instance, the open end of the pipe 502 is slightly larger than the spherical connector 12, creating friction that holds them together. This method relies on the pressure generated from the tight fit to maintain the connection. It is recommended that the end portion of the pipe 502 be cut at an angle 504 between 30-45 degrees. Exceeding 45 degrees may reduce the bracing ability and stability of the pipe 502.

Figure 6:
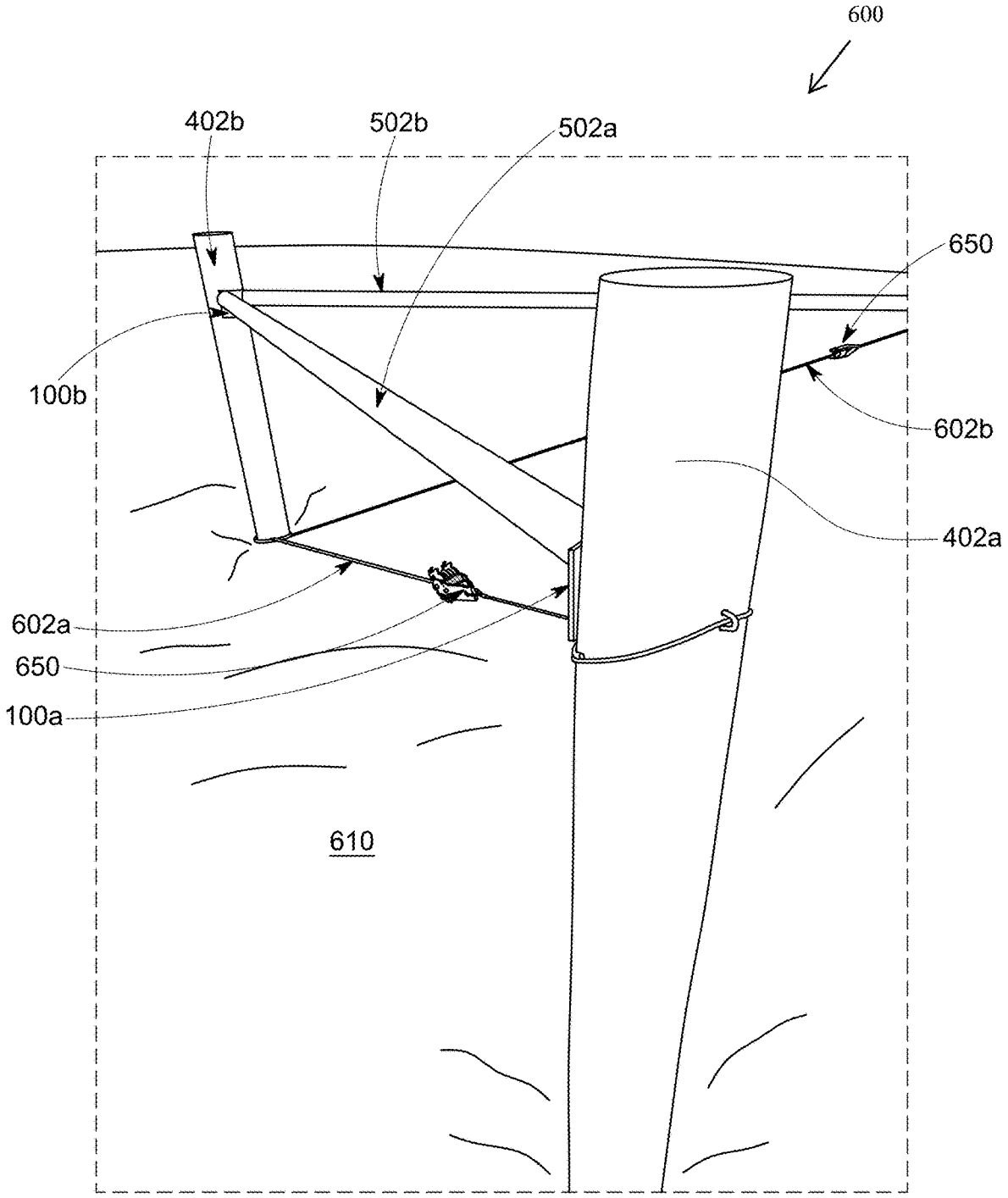
FIG. 6 is a pictorial illustration of a fence having multiple posts with the attachment bracket devices attached on the posts and rails installed over the attachment bracket devices as well as high tensile wires holding the fence posts in place.

FIG. 6 shows an example of a wooden high tensile fence system 600. The high tensile fence system 600 utilizes fence posts 402 that have one or more attachment bracket devices 100 attached via fasteners 302 to a designated location on the fence post 402. High tensile fence systems 600 may also be referred to as H-brace fences. An H-brace is a type of fence brace used to provide extra support and stability, particularly in high-tension fencing. The H-brace fence is characterized by a "H" shape formed by two vertical posts (e.g., fence post 402*a* and fence post 402*b* and a horizontal post, such as pipe 502*a*). H-braces are typically installed at corners, gate openings, or points where the fence line changes direction significantly. H-braces are crucial for preventing fence posts from bending or pulling out under the tension of the wire, especially in high-tensile fencing. Proper H-brace installation is key to a strong, long-lasting, and stable fence. The terms "high tensile fence system" and "H-brace" fences are interchangeable.

As shown in the example high tensile fence 600 arrangement in FIG. 6, the first fence post 402*a* is mounted vertically upright into the ground 610 and also has a first attachment bracket device 100*a* attached to the fence post 402*a* as shown in FIG. 6. Another fence post 402*b* is mounted into the ground 610 and stands upright a desired distance from the first fence post 402*b*. The fence installer then has an elongated pipe 502*a* cut to the desired length and connects one end of the pipe 502*a* to the spherical connector 12 of the attachment bracket device 100*a* and the other open end of the pipe 502*a* is fitted over the spherical connector 12 of the attachment bracket device 100*b* attached to the second fence post 402*b*. FIG. 6 shows that a thinner wire 602*a* extends at an angle between the first fence post 402*a* and the second fence post 402*b*. The wire 602 may be a bracing wire or a twitch wire. The bracing wires or twitch wires 602 may be a piece of wire used to create a tensioned brace in a fence 600, particularly in H-braces. It transfers force between the posts of the brace, providing lateral strength to the fence. The wire 602 is typically installed diagonally between the top of one fence post (e.g., 402*a*) and the bottom of another post (e.g., 402*b*), and can be tightened with a tool called an inline strainer 650 as shown in FIG. 6. The bracing wire 602 wraps around the top of the first fence post 402*a* and wraps around the bottom of the second fence post 402*b* and can be tightened with the inline strainer 650. The fence system 600 includes additional pipes 502*b* that extend from the second fence post 402*b* to another fence post to extend the fencing system 600 over an area as desired.

Advantageously, using the fencing system shown in FIGS. 1-9, in one or more non-limiting embodiments, the user does not have to cut or bore holes into the wooden or non-wooden fence posts 402, which can degrade the wooden or non-wooden material of the fence post 402 over time and creates excessive waste. To use the attachment bracket device 100/200, the user only has to minimally drill small fastener holes into the fence post 402 where the attachment bracket device 100/200 needs to be placed to receive a pipe 502. The small fastener holes for inserting the fasteners 302 through the fastener holes 20 do not cause the same amount of damage as cutting deep holes or grooves in the fence post 402 as traditional methods cause. Further, the system 600 using the attachment bracket devices 100/200 spread the compressed load applied to the attachment bracket device 100/200 across more face of the fence posts 402 when compared to the normal boring in the fence posts 402. The attachment bracket devices 100/200 are easy to install by using the lag screw/fastener 302 to install the attachment bracket devices 100/200 onto a desired side or surface of the fence post 402. Another advantage of the bracket system 100/200 shown in FIGS. 1-9 is the use of the attachment bracket devices 100/200 for all useable angles of bracing, which also makes it easier for all levels of skill when installing a high tensile fence, which requires a higher level of training and skill. Even if there is some miscalculation about the positioning of the attachment bracket devices 100/200, if the attachment bracket device 100/200 has to be removed, the user can unfasten the fasteners 302 to remove the attachment bracket devices 100/200 and then reinstall the attachment bracket devices 100/200 with ease until a desired fence post and related pipes 502, wires 602, and inline strainers 650 are fully placed and fitted together to create the desired fence system 600.

Figure 7:
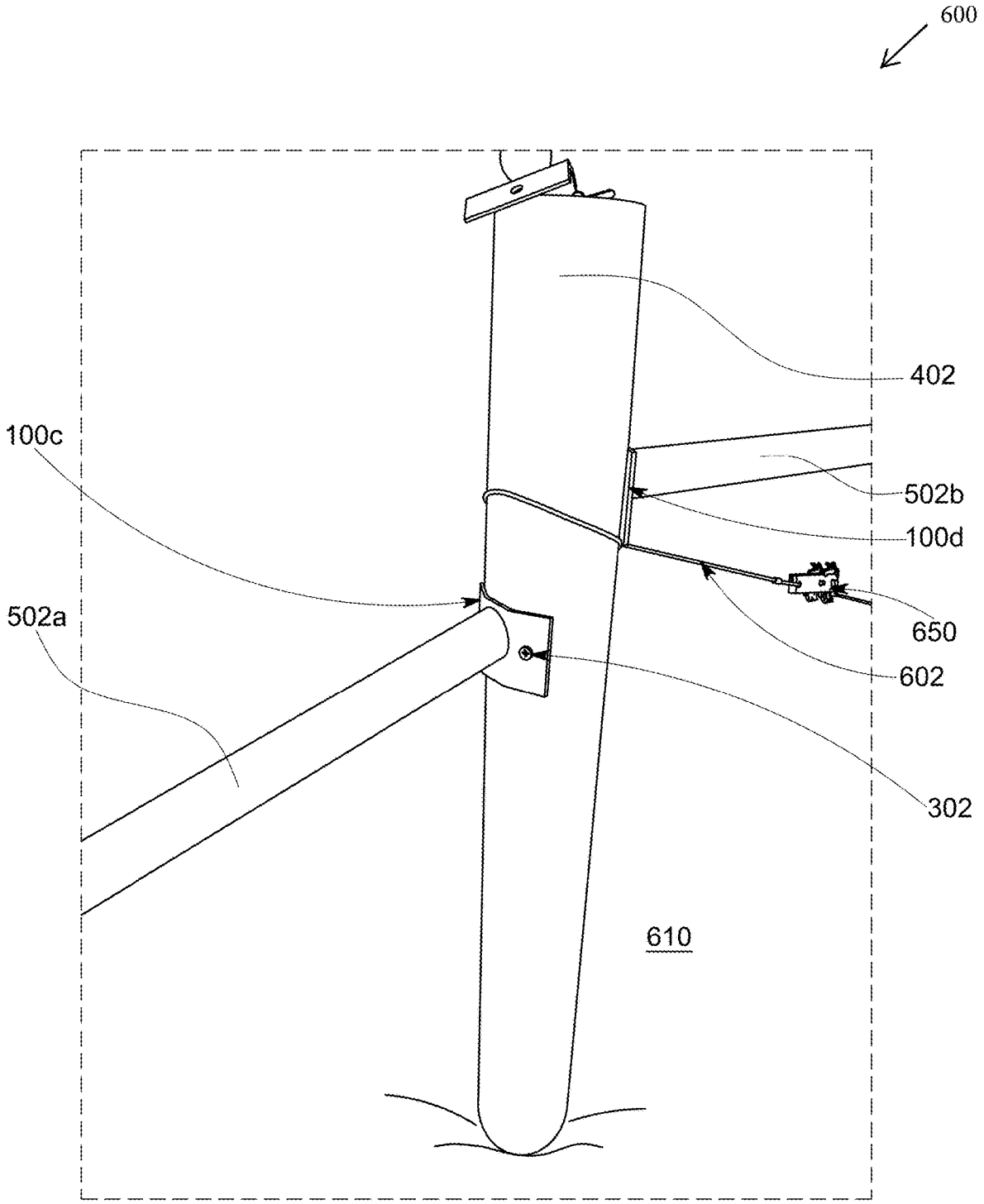
FIG. 7 is a pictorial illustration of a fence post with multiple attachment bracket devices attached to both a front side and a rear side of the fence post and multiple rails installed on the spherical connectors of the attachment bracket devices.

FIG. 7 shows that the attachment bracket devices 100/200 may be installed/attached to the fence posts 402 at different heights and positions on the fence post 402 as needed. FIG. 7 shows that the first attachment bracket 100*c* is positioned lower on one side of the fence post 402 than the second attachment bracket 100*d*. A first pipe 502*a* is of a slightly larger diameter to fit onto the spherical connector 12 of the attachment bracket device 100*c*. A user may need to cut the end opening of the pipe 502*a* at an angle if needed to cause the pipe 502*a* to fit over the spherical connector 12 of the attachment bracket device 100*c*. The pipe 502*a* covers the spherical connector 12 (which is covered by the attached pipe 502) on attachment bracket 100*c*. The second pipe 502*b* covers and fits snugly over the spherical connector 12 of the attachment bracket device 100*d* as well. The pipes 502 are intended to extend horizontally between two vertical fence posts 402 (e.g., 402*a* and 402*b*), and bracing wires 602 and inline strainers 650 may be used to tighten the connection and fit between the pipe 502, attachment bracket devices 100/200, and fence posts 402*a*, 402*b* as needed.

Figure 8:
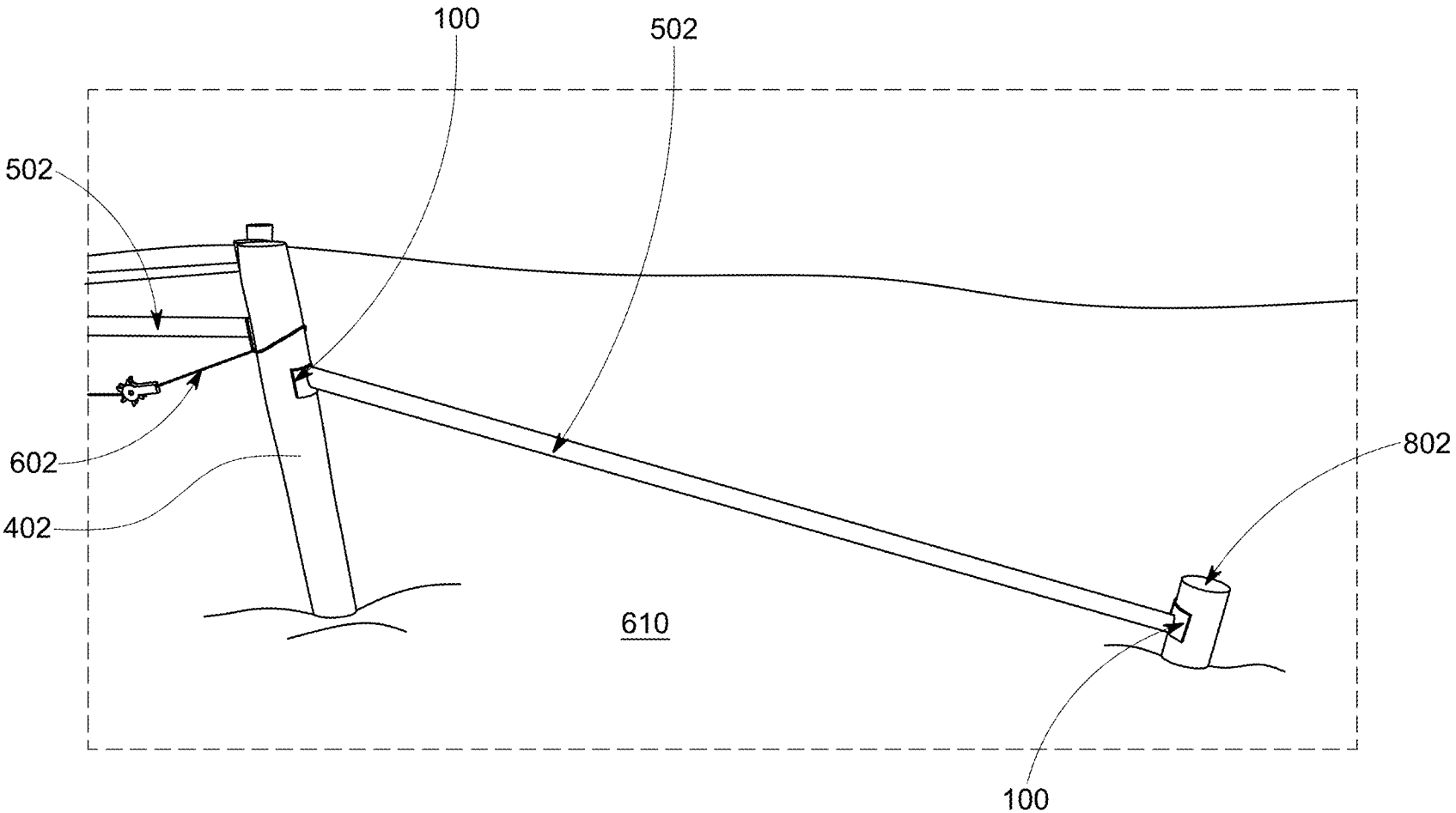
FIG. 8 is a pictorial illustration of a fence post with the attachment bracket device installed on a fence post and a rail connected to a footer.

FIG. 8 depicts another use of the attachment bracket devices 100/200 for building a fence. A footer, such a footer 802, may be a shorter version of a fence post 402. To terminate the fence 600, the user may install a pipe, such as pipe 502 in FIG. 8 at an angle to connect between an attachment bracket devices 100*e* and 100*f*.

Figure 9:
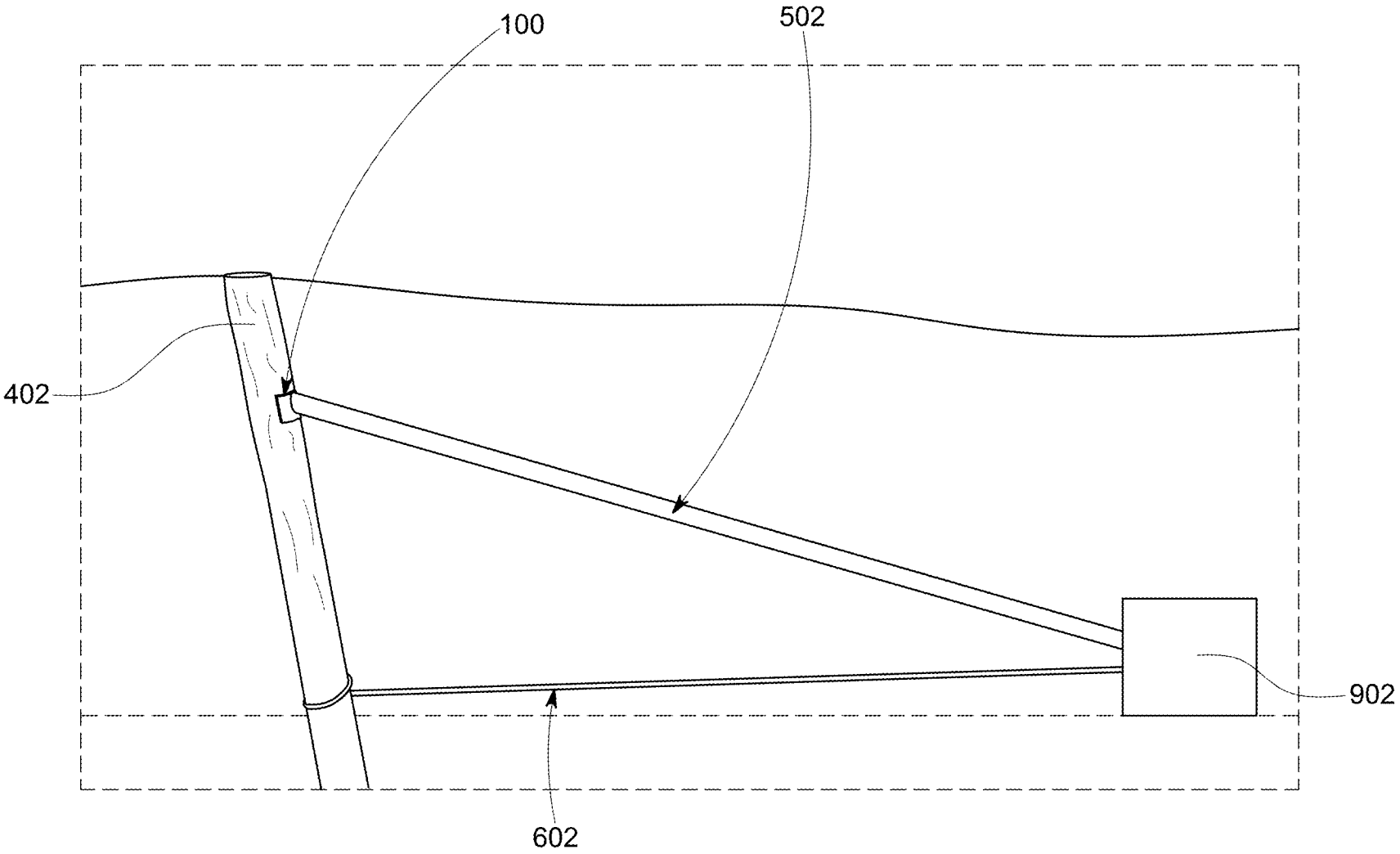
FIG. 9 is a pictorial illustration of a fence post with the attachment bracket device installed on a fence post and a rail attached to a stone.

FIG. 9 depicts another way that a fencing system 600 may be installed. A stone block 902 may be utilized instead of a footer 802, as shown in FIG. 8. Notably, stone block 902 may be above or below or at ground level 610. The attachment bracket device 100 may be installed onto the fence post 402 and a pipe 502 angled down to the stone block 902 for stabilizing the posts 402. An additional bracing wire 502 and/or strainer 650 may also be utilized.

Figure 10:
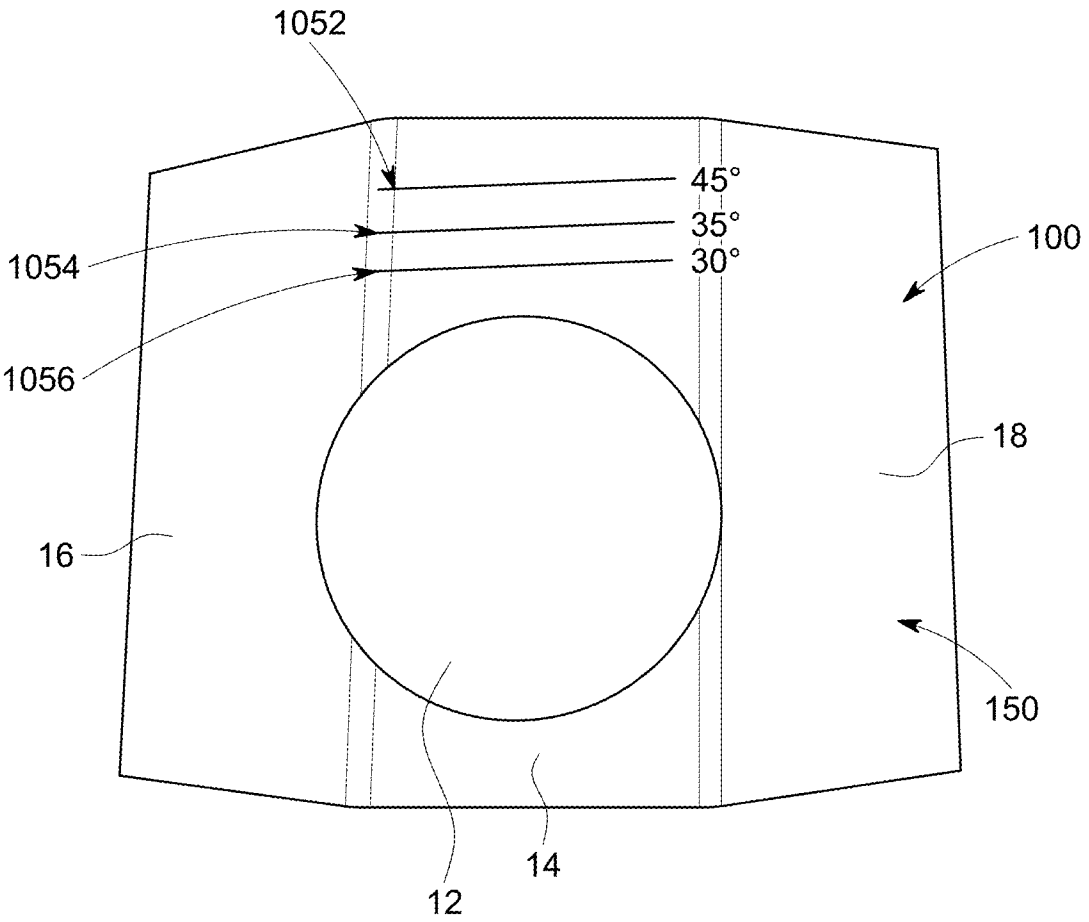
FIG. 10 is a pictorial illustration for the attachment bracket with additional line markings related to the degree or angle that a pipe is to be cut to fit over the at least one spherical connector.

FIG. 10 shows an example of the attachment bracket 100 that may include at least one spherical connector 12. The attachment bracket 100 may include either printed or inscribed lines or marks, such as lines or marks 1052, 1054, and 1056. The attachment bracket 100 may be located above the top of the spherical connector 12. Each line 1052, 1054, and 1056 may include a display of a number for an angle (e.g., such as 45 degrees, 35 degrees, and 30 degrees) as shown in FIG. 10 in descending numerical order. The lines or marks 1052-1056 may alternatively be positioned beneath the spherical connector 12. The lines or marks 1052-1056 would show that the relative angle of the pipe 502 being installed and indicate the pipe's 502 positioning on the plate body 10. That aspect would relieve the user of having to estimate or use an angle finder to determine the appropriate angle of installation for the pipe 502. It is noted that the lines, such as line 1052, 1054, and 1056 for indicating how a pipe 502 used in the fencing system 600 should be cut and at what angle 504 so that the ends of each pipe 502 fits onto the spherical connector 12. It is noted that the line markings 1052-1056 may be included on either the attachment bracket (e.g. attachment bracket 100) having one spherical connector 12 or two spherical connectors 12 (e.g. attachment bracket 200).

Figure 11:
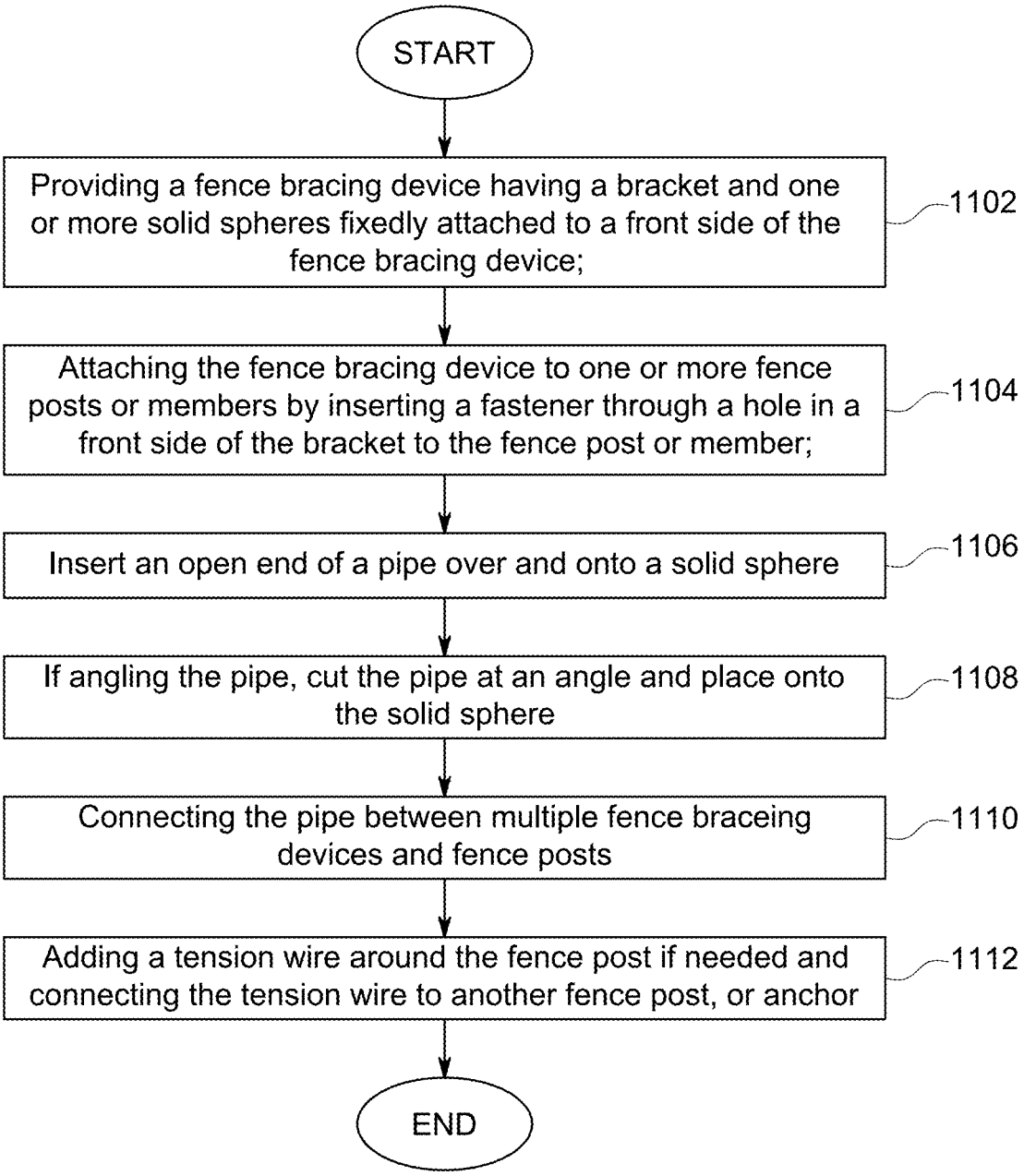
FIG. 11 is an exemplary flow chart having an exemplary method of using an attachment bracket device.

FIG. 11 shows an exemplary method in a flowchart for using the attachment bracket devices 100/200. At step 1102, the method may include providing a fence bracing device 100/200 having a bracket/plate body 10 and one or more solid spheres 12 fixedly attached to the front side of the plate body 10. The next step 1104 may include attaching the fence bracing device 100/200 to the front or back of a fence post 402 by inserting one or more fasteners 302 through a fastener hole 20 extending through the plate body 10 and into the fence post 402. The next step 1106 may include inserting an open end of a pipe 502 over and onto the solid sphere 12 of the attachment bracket device 100/200. The next step 1108 may include cutting the straight end of an open ended pipe 502 at an angle for angling the pipe or if needed to make the pipe 502 fit snugly over the spherical connector 12 of the plate body 10. The cut pipe 502 may be inserted onto and over the solid sphere 12 of the plate body 10 of the attachment bracket device 100/200. At step 1110, the method may include connecting the pipe 502 between multiple vertically oriented fence posts 402, which have been previously inserted into the ground 610. At step 1112, the method may include adding one or more tension wires 650 that wrap around the fence posts 402 to further brace the fence posts 402 in place.

Many other uses and advantages are offered by the holder 100 as described above in one or more non-limiting embodiments in the present description.

In the Summary above and in this Detailed Description, and the claims below, and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The term "comprises" and grammatical equivalents thereof are used herein to mean that other components, ingredients, steps, among others, are optionally present. For example, an article "comprising" (or "which comprises") components A, B, and C can consist of (i.e., contain only) components A, B, and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "set" as used herein may refer to one or more items. Accordingly, "set" may mean a single item or more than one item.

The term "at least" followed by a number is used herein to denote the start of a range beginning with that number (which may be a range having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)-(a second number)," this means a range whose lower limit is the first number and whose upper limit is the second number. For example, 25 to 100 mm means a range whose lower limit is 25 mm and upper limit is 100 mm.

Certain terminology and derivations thereof may be used in the following description for convenience in reference only and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention.

The embodiments were chosen and described in order to best explain the principles of the invention and the practical application, and to enable others of ordinary skill in the art to understand the invention for various embodiments with various modifications as are suited to the particular use contemplated. The present invention according to one or more embodiments described in the present description may be practiced with modification and alteration within the spirit and scope of the appended claims. Thus, the description is to be regarded as illustrative instead of restrictive of the present invention.

What is claimed is:

1. A system for a high tensile bracing fence system, comprising:

a fence post;

an attachment bracket, the attachment bracket configured to be attached to the fence post, the attachment bracket comprising:

a plate body, wherein the plate body comprises a middle section formed with a left side section and a right side section, wherein the left side section is bent backwards at an angle behind the middle section, and the right side section is bent at an angle behind the middle section, the left and right side sections conforming to a cross-sectional shape of the fence post and the plate body being attached to the fence post;

at least one spherical connector formed in a shape of a sphere, wherein the at least one spherical connector is fixedly attached to a center of the middle section of the plate body, wherein the at least one spherical connector is stationary and non-movable, wherein the middle section does not include fastener holes, and wherein the at least one spherical connector is welded directly to the middle section of the plate body; and lines or marks located on the middle section of the plate body and above the at least one spherical connector, wherein the lines or the marks display a number for an angle in descending numerical order; and a pipe, wherein a first open end of the pipe is configured to fit over a respective one of the at least one spherical connectors of the attachment bracket when the attachment bracket is attached to the fence post, wherein the pipe fits by friction fit onto the respective at least one spherical connector;

wherein the lines or the marks on the middle section of the plate body show the relative angle of the pipe to the plate body and indicate the angle at which the end of the pipe should be cut such that the pipe fits over the spherical connector and abuts the middle section of the plate body.

2. The system of claim 1, wherein the at least one spherical connector has a diameter ranging between 1 inches to 4 inches.

3. The system of claim 1, wherein the at least one spherical connector has a diameter of 2 inches.

4. The system of claim 1, wherein the left side section and the right side section are bent at an angle behind the middle section ranging between 28-40 degrees.

5. The system of claim 1, wherein the left side section comprises a first fastener hole configured for receiving a first fastener and wherein the right side section comprises a second fastener hole for receiving a second fastener.

6. A system for a high tensile bracing fence system, comprising:

a set of attachment brackets, wherein each attachment bracket of the set of attachment brackets comprises:

a plate body, wherein the plate body comprises a middle section formed with a left side section and a right side section, wherein the left side section is bent at an angle behind the middle section, and the right side section is bent at an angle behind the middle section, the left and right side sections conforming to a cross-sectional shape of a fence post;

at least one spherical connector formed in a shape of a sphere, wherein the at least one spherical connector is fixedly attached to a center of the middle section of the plate body, wherein the at least one spherical connector is stationary and non-movable, wherein the middle section does not include fastener holes, and wherein the at least one spherical connector is welded directly to the middle section of the plate body; and lines or marks located on the middle section of the plate body and above the at least one spherical connector, wherein the lines or the marks display a number for an angle in descending numerical order;

a first fence post having the plate body of a first attachment bracket of the set of attachment brackets attached to the first fence post;

a pipe, wherein a first open end of the pipe is configured to fit over a respective one of the at least one spherical connectors of the first attachment bracket, wherein the pipe fits by friction fit onto the respective at least one spherical connector, wherein the pipe is made of metal; and a second fence post having the plate body of a second attachment bracket of the set of attachment brackets attached to the second fence post, wherein a second open end of the pipe is configured to fit over a respective one of the at least one spherical connectors of the second attachment bracket, wherein the pipe extends between the first fence post and the second fence post;

wherein the lines or the marks on the middle section of the plate body of each attachment bracket show the relative angle of the pipe to the plate body and indicate the angle at which the end of the pipe should be cut such that the pipe fits over the spherical connector and abuts the middle section of the plate body.

7. The system of claim 6, wherein a diameter of the at least one spherical connector is smaller than the diameter of the first open end and the second open end of the pipe.

8. The system of claim 6, wherein the left side section and the right side section are angled and bent back at a range of 25-40 degrees from the middle section of the plate body.

9. The system of claim 6, wherein the plate body and the at least one spherical connector are made of metal.

10. The system of claim 6, wherein each attachment bracket comprises at least one fastener hole configured for receiving a fastener.

* * * * *